US008482478B2

(12) United States Patent
Hartenstein

(10) Patent No.: US 8,482,478 B2
(45) Date of Patent: Jul. 9, 2013

(54) MIMO ANTENNA SYSTEM

(75) Inventor: Abraham Hartenstein, Chatsworth, CA (US)

(73) Assignee: Xirrus, Inc., Thousand Oaks, CA (US)

( * ) Notice: Subject to any disclaimer, the term of this patent is extended or adjusted under 35 U.S.C. 154(b) by 768 days.

(21) Appl. No.: 12/269,567

(22) Filed: Nov. 12, 2008

(65) Prior Publication Data

US 2010/0119002 A1 May 13, 2010

(51) Int. Cl.
*H01Q 21/00* (2006.01)

(52) U.S. Cl.
USPC ..... 343/893; 343/700 MS

(58) Field of Classification Search
USPC ..... 343/893, 702; 375/267, 299
See application file for complete search history.

(56) References Cited

U.S. PATENT DOCUMENTS

| | | | | |
|---|---|---|---|---|
| 4,042,935 | A | 8/1977 | Ajioka et al. | |
| 4,649,391 | A | 3/1987 | Tsuda et al. | |
| 4,726,050 | A | 2/1988 | Menich et al. | |
| 5,389,941 | A | 2/1995 | Yu | |
| 5,952,983 | A | 9/1999 | Dearnley et al. | |
| 6,140,972 | A | 10/2000 | Johnston et al. | |
| 6,157,811 | A | 12/2000 | Dent | |
| 6,326,926 | B1 | 12/2001 | Shoobridge et al. | |
| 6,329,954 | B1 | 12/2001 | Fuchs et al. | |
| 6,374,078 | B1 | 4/2002 | Williams et al. | |
| 6,452,565 | B1 | 9/2002 | Kingsley et al. | |
| 6,539,204 | B1 | 3/2003 | Marsh et al. | |
| 6,544,173 | B2 | 4/2003 | West et al. | |
| 6,606,059 | B1 | 8/2003 | Barabash | |
| 6,646,611 | B2 | 11/2003 | Plet et al. | |
| 6,762,726 | B2 * | 7/2004 | Alden et al. | 343/703 |
| 6,812,902 | B2 * | 11/2004 | Rossman et al. | 343/725 |
| 6,888,504 | B2 | 5/2005 | Chiang et al. | |
| 6,903,703 | B2 | 6/2005 | Durham et al. | |
| 6,933,909 | B2 | 8/2005 | Theobold | |
| 7,057,566 | B2 | 6/2006 | Theobold | |
| 7,103,386 | B2 | 9/2006 | Hoffmann et al. | |
| 7,119,744 | B2 | 10/2006 | Theobold et al. | |
| 7,193,562 | B2 | 3/2007 | Shtrom et al. | |
| 7,202,824 | B1 | 4/2007 | Sanelli et al. | |
| 7,253,783 | B2 | 8/2007 | Chiang et al. | |
| 7,274,944 | B2 | 9/2007 | Lastinger et al. | |
| 7,292,198 | B2 | 11/2007 | Shtrom et al. | |
| 7,358,912 | B1 | 4/2008 | Kish et al. | |
| 7,362,280 | B2 | 4/2008 | Shtrom et al. | |
| 7,496,070 | B2 | 2/2009 | Vesuna | |
| 7,498,996 | B2 | 3/2009 | Shtrom et al. | |
| 7,498,999 | B2 | 3/2009 | Shtrom | |
| 7,505,447 | B2 | 3/2009 | Kish et al. | |
| 7,511,680 | B2 | 3/2009 | Shtrom et al. | |
| 7,525,486 | B2 | 4/2009 | Shtrom et al. | |
| 7,567,213 | B2 | 7/2009 | Liu | |
| 7,646,343 | B2 | 1/2010 | Shtrom et al. | |
| 7,652,632 | B2 | 1/2010 | Shtrom | |
| 7,675,474 | B2 | 3/2010 | Shtrom et al. | |
| 7,696,943 | B2 * | 4/2010 | Chiang | 343/833 |
| 7,696,946 | B2 | 4/2010 | Shtrom | |
| 7,787,436 | B2 | 8/2010 | Kish et al. | |

(Continued)

*Primary Examiner* — Hoanganh Le
(74) *Attorney, Agent, or Firm* — The Eclipse Group LLP

(57) ABSTRACT

A wireless local area network ("WLAN") antenna array ("WLANAA") includes a circular housing having a plurality of radial sectors and a plurality of primary antenna elements configured as Multiple-Input, Multiple-Output (MIMO) antennas. Each primary antenna element, which includes multiple antennas connected to a single radio, being positioned within a radial sector of the plurality of radial sectors.

13 Claims, 10 Drawing Sheets

U.S. PATENT DOCUMENTS

| | | | | |
|---|---|---|---|---|
| 7,864,119 | B2 | 1/2011 | Shtrom et al. | |
| 8,078,194 | B2 | 12/2011 | Walley et al. | |
| 2001/0033600 | A1 | 10/2001 | Yang et al. | |
| 2002/0039082 | A1 | 4/2002 | Fox et al. | |
| 2002/0163933 | A1 | 11/2002 | Benveniste | |
| 2002/0186678 | A1 | 12/2002 | Averbuch et al. | |
| 2003/0040319 | A1 | 2/2003 | Hansen et al. | |
| 2003/0210193 | A1* | 11/2003 | Rossman et al. | 343/725 |
| 2004/0001429 | A1 | 1/2004 | Ma et al. | |
| 2004/0005227 | A1 | 1/2004 | Cremer et al. | |
| 2004/0052227 | A1 | 3/2004 | Judd et al. | |
| 2004/0066326 | A1 | 4/2004 | Knapp | |
| 2004/0102222 | A1 | 5/2004 | Skafidas et al. | |
| 2004/0105412 | A1 | 6/2004 | He et al. | |
| 2004/0143681 | A1 | 7/2004 | Benveniste | |
| 2004/0157551 | A1 | 8/2004 | Gainey et al. | |
| 2004/0196813 | A1 | 10/2004 | Ofek et al. | |
| 2004/0203347 | A1 | 10/2004 | Nguyen | |
| 2004/0224637 | A1 | 11/2004 | Silva et al. | |
| 2004/0240424 | A1 | 12/2004 | Fong et al. | |
| 2004/0242274 | A1 | 12/2004 | Corbett et al. | |
| 2004/0259558 | A1 | 12/2004 | Shafidas et al. | |
| 2004/0259563 | A1 | 12/2004 | Morton et al. | |
| 2005/0020299 | A1 | 1/2005 | Malone et al. | |
| 2005/0025254 | A1 | 2/2005 | Awad et al. | |
| 2005/0035919 | A1 | 2/2005 | Yang et al. | |
| 2005/0058097 | A1 | 3/2005 | Kang et al. | |
| 2005/0058111 | A1 | 3/2005 | Hung et al. | |
| 2005/0237258 | A1 | 10/2005 | Abramov et al. | |
| 2005/0254470 | A1 | 11/2005 | Yashar | |
| 2005/0255892 | A1 | 11/2005 | Wong et al. | |
| 2006/0038738 | A1 | 2/2006 | Shtrom | |
| 2006/0098616 | A1 | 5/2006 | Kish et al. | |
| 2006/0109799 | A1 | 5/2006 | Tseng et al. | |
| 2006/0233280 | A1 | 10/2006 | Tynderfeldt et al. | |
| 2007/0066234 | A1 | 3/2007 | Lastinger et al. | |
| 2007/0178927 | A1 | 8/2007 | Fernandez-Corbaton et al. | |
| 2007/0210974 | A1* | 9/2007 | Chiang | 343/757 |
| 2007/0243826 | A1* | 10/2007 | Liu | 455/67.11 |
| 2007/0293178 | A1 | 12/2007 | Milton et al. | |
| 2008/0136715 | A1 | 6/2008 | Shtrom et al. | |
| 2008/0137681 | A1 | 6/2008 | Kish et al. | |
| 2008/0221918 | A1 | 9/2008 | Petersen et al. | |
| 2008/0225814 | A1 | 9/2008 | Thermond et al. | |
| 2008/0267151 | A1 | 10/2008 | Hartenstein | |
| 2008/0268778 | A1 | 10/2008 | De La Garrigue et al. | |
| 2008/0274748 | A1 | 11/2008 | Lastinger et al. | |
| 2008/0291098 | A1 | 11/2008 | Kish et al. | |
| 2009/0028095 | A1 | 1/2009 | Kish | |
| 2009/0075606 | A1 | 3/2009 | Shtrom et al. | |
| 2010/0053010 | A1 | 3/2010 | Shtrom et al. | |
| 2010/0053023 | A1 | 3/2010 | Shtrom et al. | |
| 2010/0103065 | A1 | 4/2010 | Shtrom et al. | |
| 2010/0103066 | A1 | 4/2010 | Shtrom et al. | |
| 2010/0119002 | A1 | 5/2010 | Hartenstein | |

* cited by examiner

MIMO ANTENNA SYSTEM

BACKGROUND OF THE INVENTION

1. Field of the Invention

This invention relates generally to communication devices and more particularly to antennas for Multiple-Input, Multiple-Output (MIMO) media access controllers.

2. Related Art

The use of wireless communication devices for data networking is growing at a rapid pace. Data networks that use "WiFi" ("Wireless Fidelity"), also known as "Wi-Fi," are relatively easy to install, convenient to use, and supported by the IEEE 802.11 standard. WiFi data networks also provide performance that makes WiFi a suitable alternative to a wired data network for many business and home users.

WiFi networks operate by employing wireless access points that provide users, having wireless (or "client") devices in proximity to the access point, with access to varying types of data networks such as, for example, an Ethernet network or the Internet. The wireless access points include a radio that operates according to one of three standards specified in different sections of the IEEE 802.11 specification. Generally, radios in the access points communicate with client devices by utilizing omni-directional antennas that allow the radios to communicate with client devices in any direction. The access points are then connected (by hardwired connections) to a data network system that completes the access of the client device to the data network.

The three standards that define the radio configurations are:

1. IEEE 802.11a, which operates on the 5 GHz frequency band with data rates of up to 54 Mbs;
2. IEEE 802.11b, which operates on the 2.4 GHz frequency band with data rates of up to 11 Mbs; and
3. IEEE 802.11g, which operates on the 2.4 GHz frequency band with data rates of up to 54 Mbs.

The 802.11b and 802.11g standards provide for some degree of interoperability. Devices that conform to 802.11b may communicate with 802.11g access points. This interoperability comes at a cost as access points will switch to the lower data rate of 802.11b if any 802.11b devices are connected. Devices that conform to 802.11a may not communicate with either 802.11b or 802.11g access points. In addition, while the 802.11a standard provides for higher overall performance, 802.11a access points have a more limited range compared with the range offered by 802.11b or 802.11g access points.

Each standard defines 'channels' that wireless devices, or clients, use when communicating with an access point. The 802.11b and 802.11g standards each allow for 14 channels. The 802.11a standard allows for 23 channels. The 14 channels provided by 802.11b and 802.11g include only 3 channels that are not overlapping. The 12 channels provided by 802.11a are non-overlapping channels.

Access points provide service to a limited number of users. Access points are assigned a channel on which to communicate. Each channel allows a recommended maximum of 64 clients to communicate with the access point. In addition, access points must be spaced apart strategically to reduce the chance of interference, either between access points tuned to the same channel, or to overlapping channels. In addition, channels are shared. Only one user may occupy the channel at any give time. As users are added to a channel, each user must wait longer for access to the channel thereby degrading throughput.

One way to increase throughput is to employ multiple radios at an access point. Another way is to use multiple input, multiple output ("MIMO") to communicate with mobile devices in the area of the access point. MIMO has the advantage of increasing the efficiency of the reception. However, MIMO entails using multiple antennas for reception and transmission at each radio. The use of multiple antennas may create problems with space on the access point, particularly when the access point uses multiple radios. In some implementations of multiple radio access points, it is desirable to implement a MIMO implementation in the same space as a previous non-MIMO implementation.

It would be desirable to implement MIMO in multiple radio access points without significant space constraints such that it would be possible to substitute a non-MIMO multiple radio access point with a MIMO multiple radio access point in the same space.

SUMMARY

In view of the above, a wireless local area network ("WLAN") antenna array ("WLANAA") is provided. The WLANAA includes a circular housing having a plurality of radial sectors. Each radial sector includes at least one radio. The at least one radio is coupled to send and receive wireless communications via a plurality of antenna elements configured as Multiple-Input, Multiple-Output (MIMO) antennas. Each of the plurality of antenna elements are positioned within an individual radial sector of the plurality of radial sectors.

In another aspect of the invention, an RF sub-system is provided. The RF sub-system includes an RF printed circuit board ("PCB") having at least one radio. A plurality of antenna PCBs are mounted orthogonal to the RF PCB along an edge of the RF PCB. The antenna PCBs include a plurality of MIMO antennas connected to the at least one radio. The RF PCB includes a connector for connecting the RF sub-system to a central PCB. The central PCB includes connectors along its perimeter for connecting a plurality of RF PCBs such that the MIMO antennas provide 360 degrees of coverage when all available connectors are connected to corresponding RF PCBs.

Other systems, methods and features of the invention will be or will become apparent to one with skill in the art upon examination of the following figures and detailed description. It is intended that all such additional systems, methods, features and advantages be included within its description, be within the scope of the invention, and be protected by the accompanying claims.

BRIEF DESCRIPTION OF THE DRAWINGS

The examples of the invention described below can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of example embodiments, reference is made to the accompanying drawings that form a part of the description, and which show, by way of illustration, specific example embodiments in which the invention may be practiced. Other embodiments may be utilized and structural changes may be made without departing from the scope of the invention.

A wireless local area network ("WLAN") antenna array ("WLANAA") is disclosed. The WLANAA may include a circular housing having a plurality of radial sectors and a plurality of primary antenna elements. Each individual primary antenna element of the plurality of primary antenna elements may be positioned within an individual radial sector of the plurality of radial sectors.

In general, the WLANAA is a multi-sector antenna system that has high gain and radiates a plurality of radiation patterns that "carve" up the airspace into equal sections of space or sectors with a certain amount of pattern overlap to assure continuous coverage for a client device in communication with the WLANAA. The radiation pattern overlap may also ease management of a plurality of client devices by allowing adjacent sectors to assist each other. For example, adjacent sectors may assist each other in managing the number of client devices served with the highest throughput as controlled by an array controller. The WLANAA provides increased directional transmission and reception gain that allow the WLANAA and its respective client devices to communicate at greater distances than standard omni-directional antenna systems, thus producing an extended coverage area when compared to an omni-directional antenna system.

The WLANAA is capable of creating a coverage pattern that resembles a typical omni-directional antenna system but covers approximately four times the area and twice the range. In general, each radio frequency ("RF") sector is assigned a non-overlapping channel by an Array Controller.

Examples of implementations of a WLANAA in which multiple input, multiple output ("MIMO") schemes may be implemented, and in which example implementations consistent with the present invention may also be implemented are described in PCT Patent Application No. PCT/US2006/008747, filed on Jun. 9, 2006, titled "WIRELESS LAN ANTENNA ARRAY," and incorporated herein by reference in its entirety.

Figure 1:
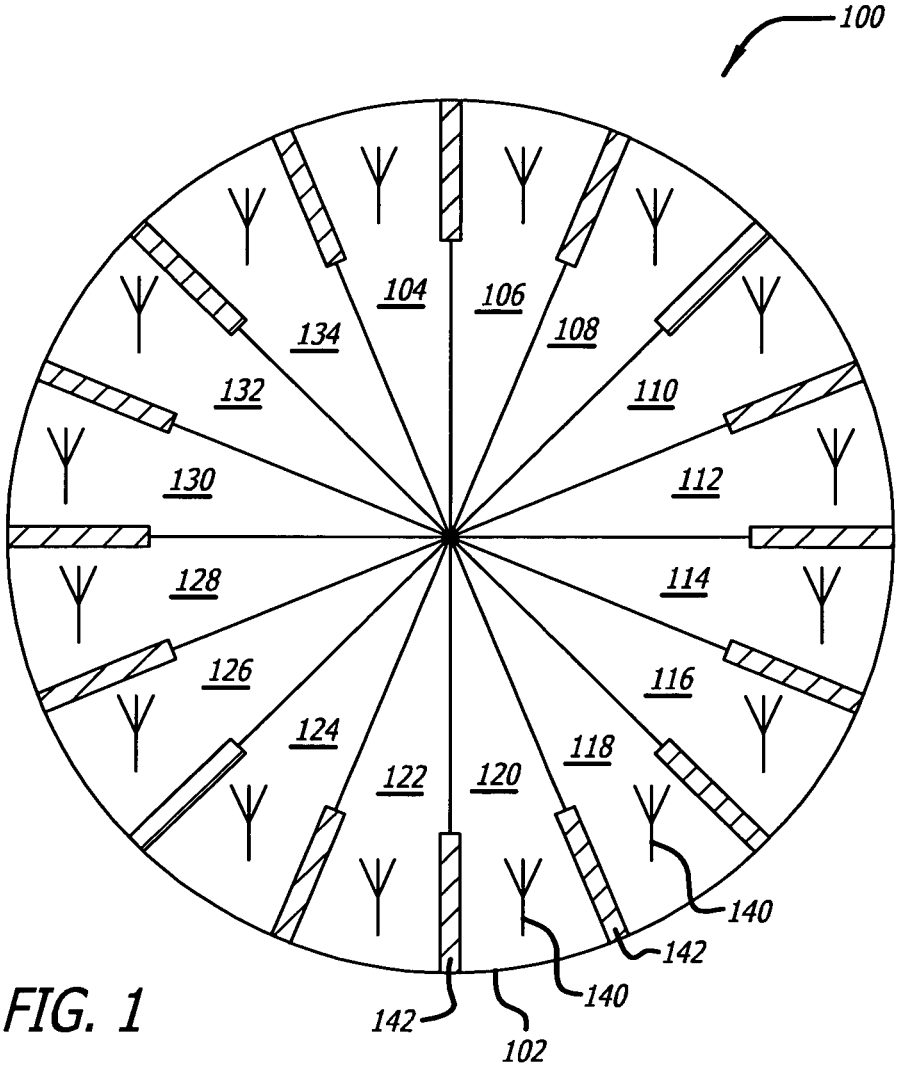
FIG. 1 is a top view of an example of an implementation of a Wireless Local Area Network ("WLAN") Antenna Array ("WLANAA").

In FIG. 1, a top view of an example of an implementation of a WLANAA 100 is shown. The WLANAA 100 may have a circular housing 102 having a plurality of radial sectors. As an example, there may be sixteen (16) radial sectors 104, 106, 108, 110, 112, 114, 116, 118, 120, 122, 124, 126, 128, 130, 132, and 134 within the circular housing 102. The WLANAA 100 may also include a plurality of primary antenna elements (such as, for example, sixteen (16) primary antenna elements similar to primary antenna element 140). Each individual primary antenna element of the plurality of primary antenna elements may be positioned within an individual radial sector of the plurality of radial sectors such as, for example, primary antenna element 140 may be positioned within its corresponding radial sector 120. Additionally, each radial sector 120 may include an absorber element such as absorber elements 142. The absorber elements 142 may be of any material capable of absorbing electromagnetic energy such as, for example, foam-filled graphite-isolated insulators, ferrite elements, dielectric elements, or other similar types of materials.

Each of the primary antenna elements 140 may be a two element broadside array element such as coupled line dipole antenna element. It is appreciated by those skilled in the art that other types of array elements may also be utilizing including but not limited to a patch, monopole, notch, Yagi-Uda type antenna elements.

Figure 2A:
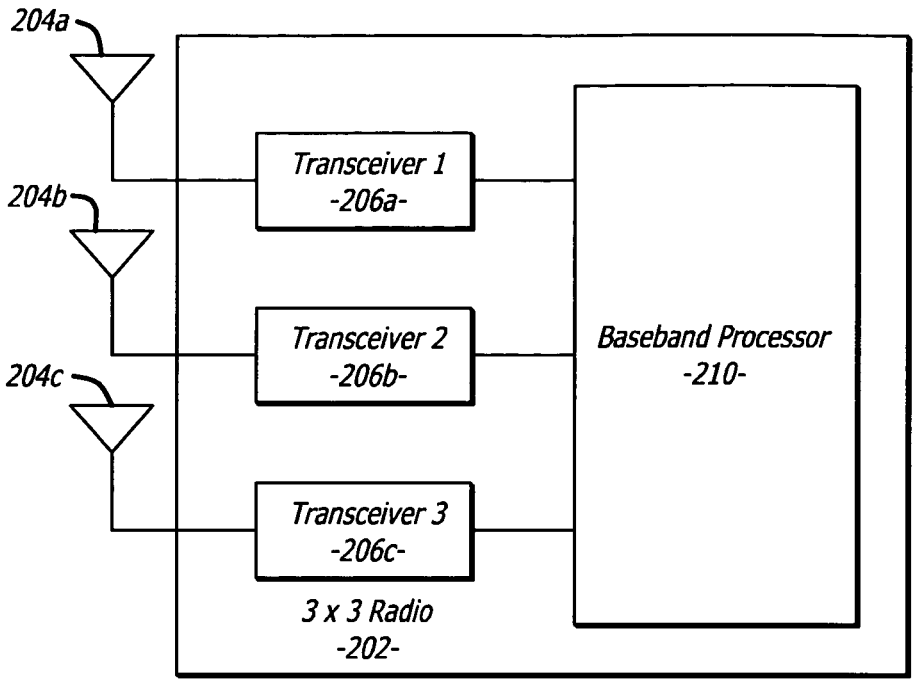
FIG. 2A is a block diagram depicting a 3×3 MIMO radio.

The WLANAA implementation in FIG. 1 includes a single antenna for each radio in the radial sectors, such as radial sector 120. The WLANAA implementation in FIG. 1 does not use MIMO. Typical MIMO systems include multiple antennas for a single radio. FIG. 2A is a block diagram depicting a 3×3 MIMO radio 202. The MIMO radio 202 sends and receives signals via multiple antennas 204*a-c*. Each antenna 204*a-c* is connected to a corresponding transceiver 206*a-c*. The transceivers 206*a-c* process signals received at the corresponding antennas 204*a-c* to extract a baseband signal. The transceivers 206*a-c* also modulate the baseband signals received for transmission via the antenna 204*a-c*. The baseband processor 210 processes the baseband signal being sent or received by the radio 202.

The radio 202 in FIG. 2A uses three antennas 204*a-c*. The three antennas 204*a-c* may take up enough space in a printed circuit board (PCB) to complicate implementation in a multiple radio access point, for example.

Figure 2B:
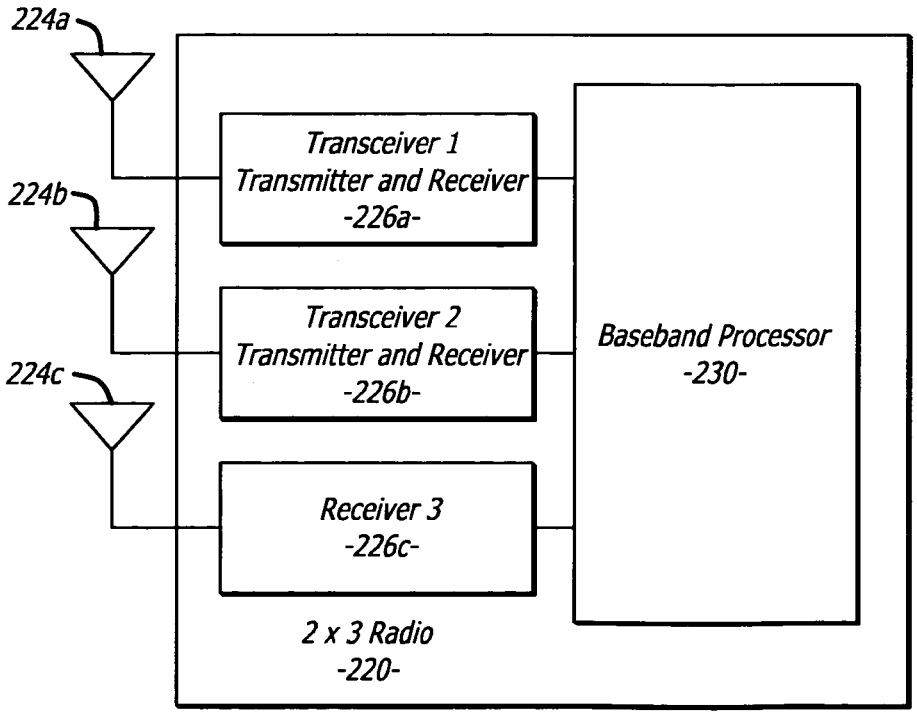
FIG. 2B is a block diagram depicting a 2×3 MIMO radio.

FIG. 2B is a block diagram depicting a 2×3 MIMO radio 220. The 2×3 MIMO radio 220 includes three antennas 224*a-c*, a first transceiver 226*a*, a second transceiver 226*b*, a receiver 226*c*, and a baseband processor 230. The 2×3 MIMO radio 220 includes 3 receivers (transceivers 226*a-b* and receiver 226*c*) and 2 transmitters (transceivers 226*a-b*).

Figure 3:
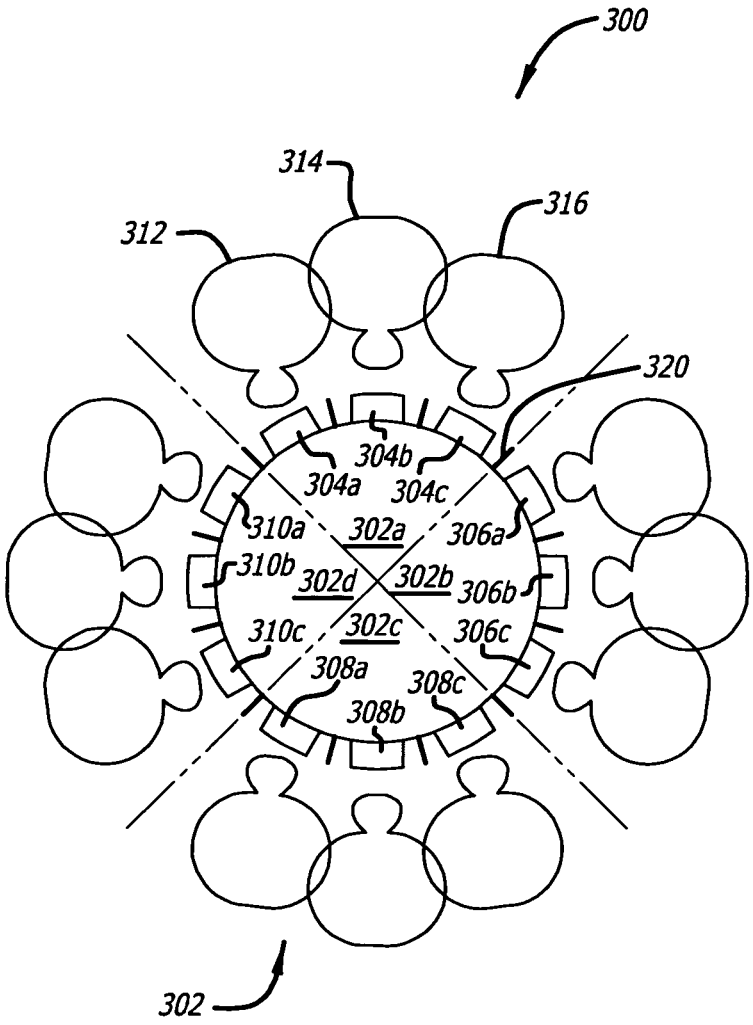
FIG. 3 is a top view of schematic diagram of an example implementation of a WLANAA that implements MIMO.

FIG. 3 is a top view of schematic diagram of an example implementation of a WLANAA 300 that implements MIMO. The WLANAA 300 in FIG. 3 includes four radial sectors 302*a-d*. Each radial sector 302*a-d* includes one radio (not shown) connected to three antenna components. For example, a first radial sector 302*a* includes antenna components 304*a-c*. A second radial sector 302*b* includes antenna components 306*a-c*. A third radial sector 302*c* includes antenna components 308*a-c*. A fourth radial sector 302*d* includes antenna components 310*a-c*. The four radial sectors 302*a-d* provide full 360° coverage. In one example, the antennas conform to the 802.11bg standard. Operation of other examples may conform to other standards.

The antenna components 304*a-c*, 306*a-c*, 308*a-c*, 310*a-c* may include three 2-element arrays. For example, the three antenna components 304*a-c* in the first radial sector 302*a* may include a first 2-element array 312, a second 2-element array 314, and a third 2-element array 316. The three 2-element arrays (for example, 2-element arrays 312, 314, 316) in each sector 302*a-d* may generate three overlapping beams 318, 320, 322 providing space diversity, all within the sector's look angles. In one example, the azimuth 3 dB of each of the beams is about 50-60 degrees with peak gain of 4 dBil. A foam absorber element 320 may be placed between each antenna component 304*a-c*, 306*a-c*, 308*a-c*, 310*a-c* to improve isolation.

Figure 4:
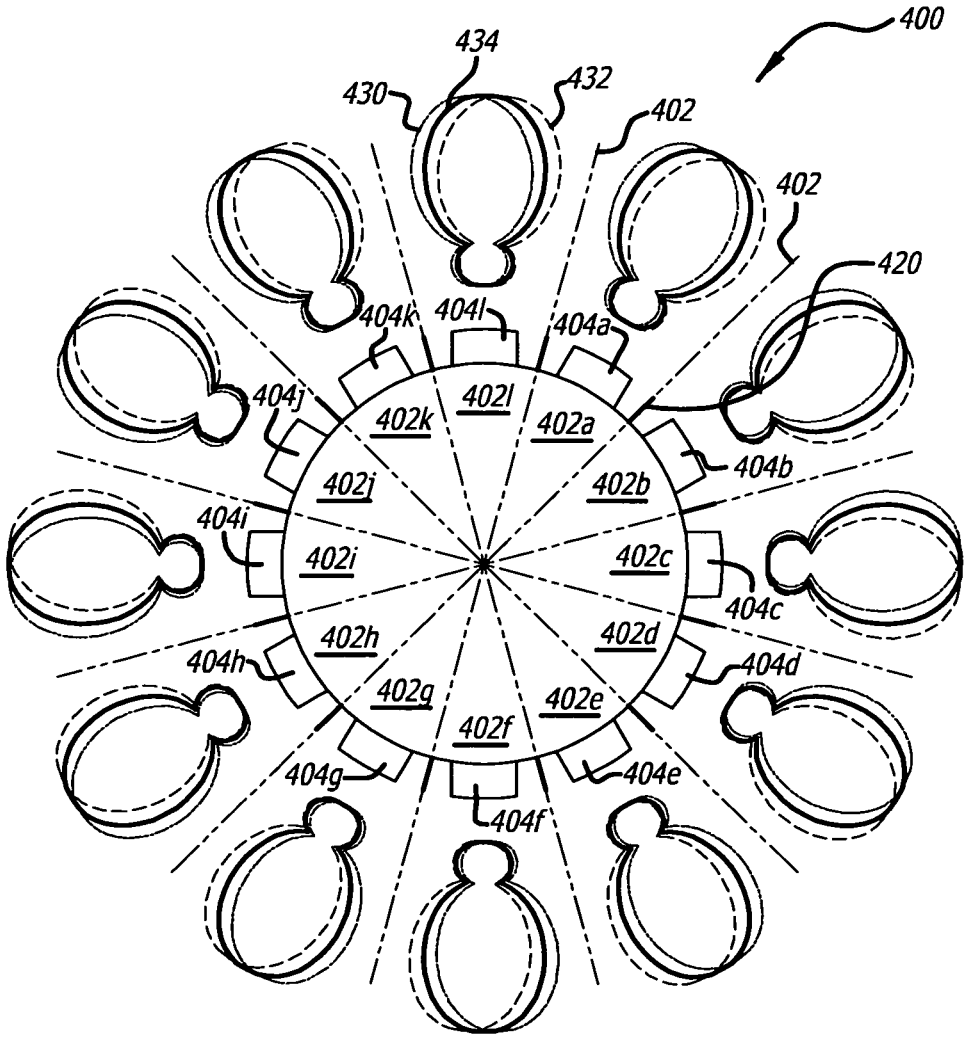
FIG. 4 is a top view of schematic diagram of another example implementation of a WLANAA that implements MIMO.

FIG. 4 is a top view of schematic diagram of another example implementation of a WLANAA 400 that implements MIMO. The WLANAA 400 in FIG. 4 includes twelve radial sectors 402*a-l*. Each radial sector 402*a-l* in FIG. 4 includes one radio (not shown) connected to three antennas configured on antenna components. For example, a first radial sector 402*a* includes a connection to a first antenna component 404*a*. Each of the remaining radial sectors 402*b-l* includes a connection to a corresponding antenna component 404*b-l*. An absorber element 420 may be placed between each of the antenna components 404*a-l* to improve isolation. The antenna components 404 and radios in the radial sectors 402 in one example implementation operate according to the IEEE 802.11a standard.

Each antenna component 404 in each radial sector 402 includes three antennas. In the example shown in FIG. 4, the antennas are arranged to provide polarization diversity. Each antenna component 404 includes a −45° array 430, a +45° array 432, and a horizontally polarized array 434, which generate beams that are orthogonal to each other as described below with reference to FIGS. 5 and 6.

Figure 5:
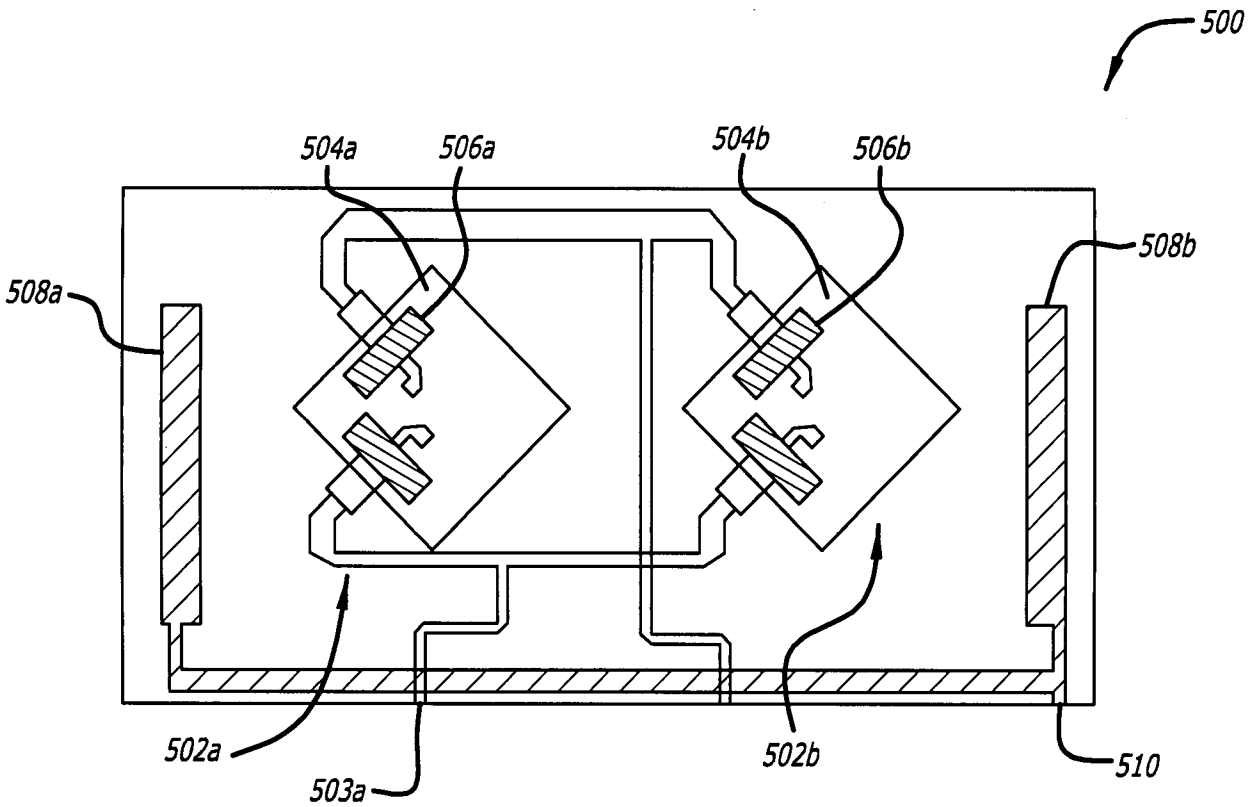
FIG. 5 is a diagram depicting an example of a printed circuit board implementation of antennas that may be used in a WLANAA that uses MIMO.

FIG. 5 is a diagram of an example of a printed circuit board (PCB) 500 implementation of antennas that may be used in a WLANAA that uses MIMO. The PCB 500 may be used to implement an antenna component of the first type of radial sectors described above with reference to FIG. 3, and the antenna components in the second type of radial sectors described above with reference to FIG. 4. For example, the PCB 500 includes one of the three two-element arrays 312, 314, 316 in the first type of radial sectors. The PCB 500 also includes two of the three antenna arrays 430, 432, 434 in the antenna modules 404 described above with reference to FIG. 4. The PCB 500 may be mounted vertically relative to a main PCB containing the radios that use the antennas.

In one example of the PCB 500 in FIG. 5, the two-element array may be implemented as one of the three IEEE 802.11bg two-element antenna arrays ('bg antenna arrays') 312, 314, 316 that operate according to the IEEE 802.11bg standard. The 'bg' antenna array in FIG. 5 includes two monopole antennas 508*a,b* that include a first element 508*a* and a second element 508*b*. The two monopole antennas 508*a,b* are combined to a feedpoint 510.

The two antenna arrays are two of the three IEEE 802.11a antenna arrays ("'a' antenna arrays") that may be used to operate according to the IEEE 802.11a standard. The two 'a' antenna arrays on the PCB 500 in FIG. 5 share one two-element patch antenna sub-array 502*a,b* excited by two orthogonal feed networks 503*a,b*. The patch antenna sub-arrays 502*a,b* are aperture coupled patch structures having a patch element 504*a,b* on a top layer coupled to an aperture 506*a,b* in a mid-layer. The two element patch antenna sub-arrays 502*a,b* are dual-polarized antennas configured at the +45° and −45° polarizations, which are in the same plane orthogonal to one another.

The third 'a' antenna array may be implemented as a third orthogonal polarization, which is the horizontal polarization orthogonal to the +45° and −45° polarizations on the vertically mounted PCB 500. The horizontal polarization antenna is provided by a horizontal two element dipole antenna on a PCB that is horizontal to the PCB 500. In an example, the PCB 500 may be mounted vertically on a main PCB as described below with reference to FIG. 6.

Figure 6:
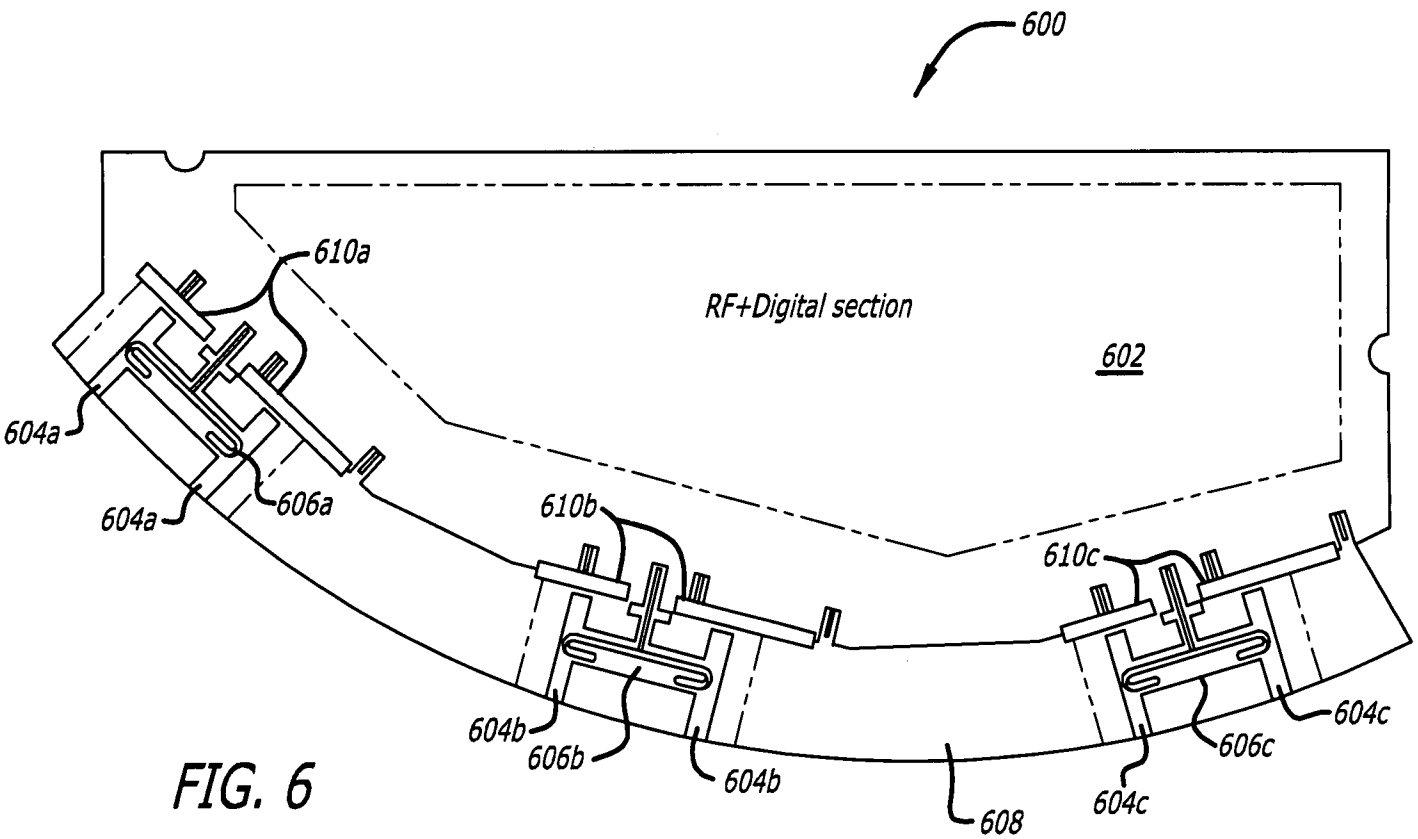
FIG. 6 is a top view of a main radio frequency (RF) PCB that may be used in an example implementation of a WLANAA that uses MIMO.

FIG. 6 is a top view of a main radio frequency (RF) PCB 600 that may be used in an example implementation of a WLANAA that uses MIMO. The main RF PCB 600 includes an RF and digital section 602, which contains the circuitry that implements the radio transceivers and baseband processor functions. The RF and digital section 602 is connected to antennas on an outer edge area 601, which may be directed towards a coverage area. The antennas on the main RF PCB 600 include three dipole two-element arrays 604*a-c* formed on a mid-layer of the PCB 600. Each of the three dipole two-element arrays 604*a-c* connect to the RF and digital section 602 via a dipole feed 606*a-c* formed on a top layer of the PCB 600 between the dipole elements of each of the dipole two-element arrays 604*a-c*.

The three dipole two-element arrays 604*a-c* provide the horizontal polarization of the three 'a' antenna arrays 430, 432, 434 described above with reference to FIG. 4. The other two 'a' antenna arrays of the three 'a' antenna arrays may be formed on an antenna module, which may be an example of the PCB 500 described with reference to FIG. 5. Three antenna modules may be mounted at connectors 610*a,b,c* on the main RF PCB 600 orthogonal to the main RF PCB 600. Each of the three dipole two-element arrays 604*a-c* may be located to four radial sectors as shown in FIG. 4 along the circumference of a circle formed by the outer edge area 601. An isolation enhancement ground strip 608 may be positioned between each of the three dipole two element arrays 604*a-c*.

Figure 7:
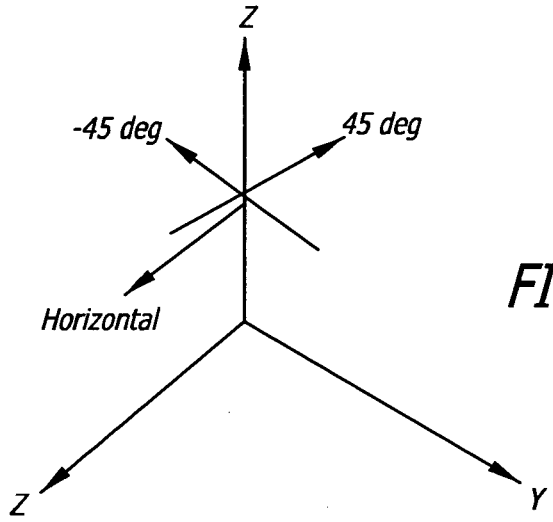
FIG. 7 shows a polar coordinate system that characterizes the polarization of antenna elements configured for polarization diversity.

FIG. 7 shows a polar coordinate system that characterizes the polarization of antenna elements configured for polarization diversity. The polar coordinate system has a −45° component, a +45° component and a horizontal component against x-y-z coordinates. Each component is orthogonal to each of the other components. The −45° component and the +45° component are implemented as the patch antenna sub-arrays 502*a,b* on the vertically mounted PCB 500 in FIG. 5. The horizontal component is implemented on the main RF PCB 600 on a horizontal plane orthogonal to the −45° component and the +45° component.

Figure 8:
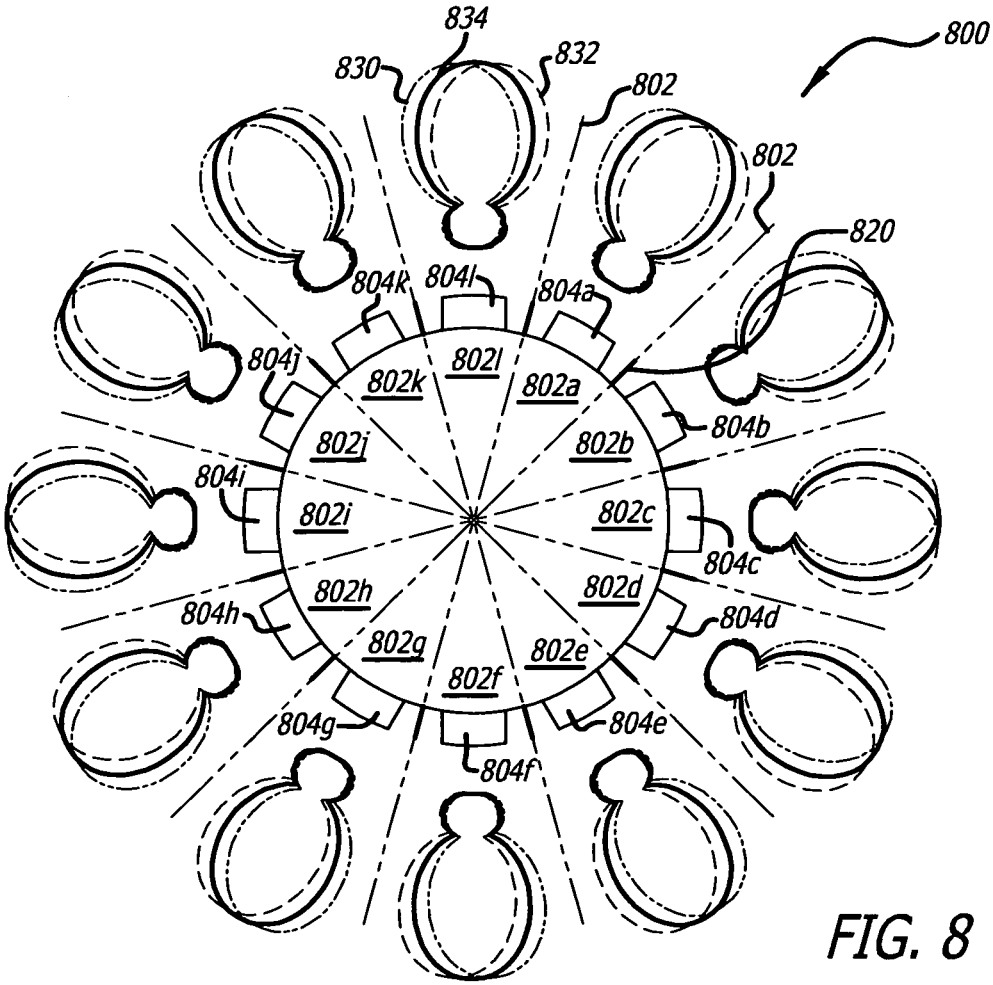
FIG. 8 is a top view of another example implementation of a WLANAA that uses MIMO.

FIG. 8 is a top view of another example implementation of a WLANAA 800 that uses MIMO. The WLANAA 800 in FIG. 8 is similar to the WLANAA 400 in FIG. 4. The WLANAA 800 in FIG. 8 includes twelve radial sectors 802*a-l*. Each radial sector 802*a-l* in FIG. 4 includes one radio (not shown) connected to three antenna elements in antenna modules. For example, a first radial sector 802*a* includes a connection to a first antenna module 804*a*. Each of the remaining radial sectors 802*b-l* includes a connection to a corresponding antenna module 804*b-l*. An absorber element 820 may be placed between each of the antenna modules 804*a-l* to improve isolation. An example of the WLANAA 800 in FIG. 8 is described here as an implementation of antennas for IEEE 802.11a radios. The example configuration shown in FIG. 8 may be used in applications in which there are multiple radios in relatively small sector spaces. In examples described here, there are more IEEE 802.11a radios in the WLAN access point than other types of radios in the radial sectors. In other examples, the WLANAA 800 may be implemented for other types of radios.

Each antenna module 804 in each radial sector 802 includes three antennas. In the example shown in FIG. 8, each antenna module 804 includes:

- a left 1×2 dipole sub-array, which creates a first coverage pattern 830,
- an embedded antenna, which creates a second coverage pattern 834, and
- a right 1×2 dipole sub-array, which creates a third coverage pattern 832.

The antennas are linearly polarized and arranged to permit a reflector to squint the beam for each sector in order to effectively illuminate its corresponding sector. The reflector used in the antennas shown in FIG. 8 is described in more detail below with reference to FIG. 9.

Figure 9:
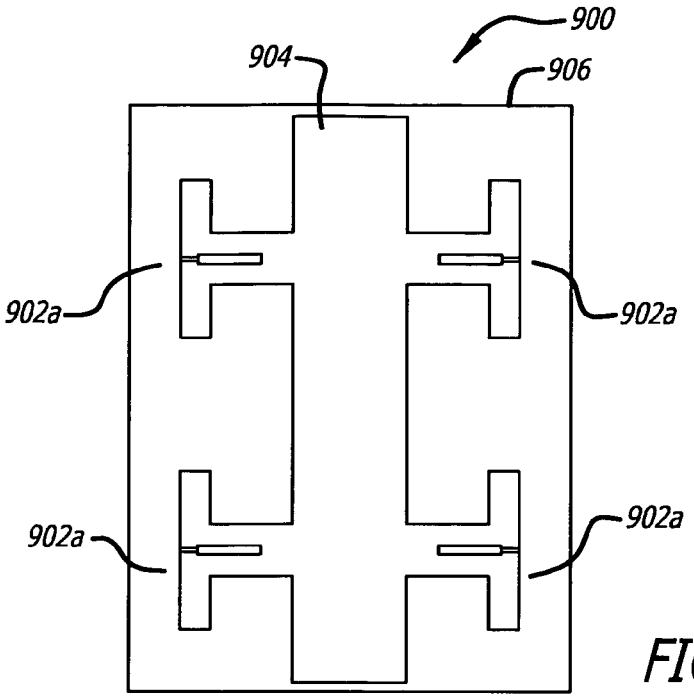
FIG. 9 is a diagram of another example of a printed circuit board implementation of antennas that may be used in a WLANAA that uses MIMO.

FIG. 9 is a diagram of another example of a printed circuit board (PCB) 900 implementation of antennas that may be used in the WLANAA 800 of FIG. 8. The PCB 900 in FIG. 9 includes antennas configured such that the beams are squinted in a space diversity arrangement. The antennas are vertically polarized with higher gain, guaranteeing more sensitivity and efficient coverage.

The PCB 900 includes three antennas per sector as described in FIG. 8. The isolation between the antennas should be minimized in order to minimize the correlation between the radios. In an 802.11a antenna structure, the PCB 900 includes two antennas 902*a,b* printed on the PCB 900, which may be mounted vertically on a main RF PCB, such as the main RF PCB 600 in FIG. 6. The antennas 902*a,b* may be printed dipoles with a multi-layer feed network. Each of the antennas 902*a,b* on the vertical PCB 900 is a 1×2 dipole sub-array printed on the PCB 900 with a reflector 904 between them. The reflector 904 provides more focused energy and an improved gain within the sectors and beyond. Cross-talk between the sectors is minimized by providing isolation between the sectors, particularly behind the target sector by keeping energy from radiating back behind the antenna. The 802.11a antenna structure on the PCB 900 typically has a larger area physically thereby adding more apertures to the antenna, and thus increasing its directivity/gain.

The third antenna of the three-element array may be the embedded horizontal antenna described above with reference to FIG. 6. As shown in FIG. 6, the three dipole two-element arrays 604*a-c* horizontal antennas are embedded near connections to a vertically mounted PCB 900 to implement the linear polarization configuration of the 802.11a structure in FIG. 8.

Antennas for each of the sectors in the access point should maintain low correlation and high isolation (20-30 dB). The general isolation between antennas in neighboring sectors should be maintained around 50 dB for the 802.11a band and 30 dB for the 802.11bg. The antenna gain is maximized as the efficiency increases.

Figure 10:
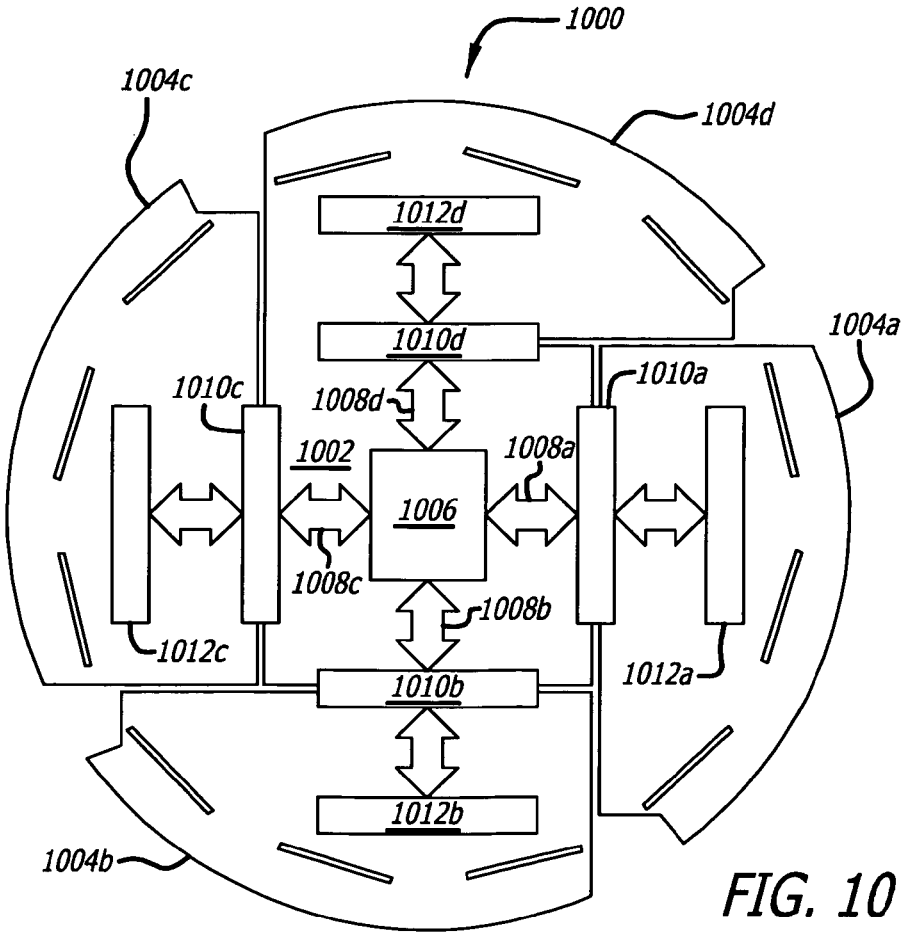
FIG. 10 is a top view of an example WLAN system that implements a plurality of main RF PCB's to operate as a WLAN access point.

FIG. 10 is a top view of an example WLAN system 1000 that implements a plurality of main RF PCB's to operate as a WLAN access point. As described above with reference to FIGS. 5, 6 & 9, the main RF PCB 600 may implement multiple MIMO antenna solutions. The PCB 900 in FIG. 9 includes one of the three two-element arrays 312, 314, 316 in the first type of radial sectors described with reference to FIG. 3, as well as two of the three antenna array in the second type of radial sectors described above with reference to FIGS. 4 and 8. By mounting three PCBs 500 or three PCBs 900 on the main RF PCB 600, the three two-element arrays 312, 314, 316 may be used as MIMO antenna elements for the 802.11bg radio described above with reference to FIG. 3. In addition, either the two-element patch antenna sub-array 502*a,b* on the PCB 500 in FIG. 5, or the 1×2 dipole antenna sub-arrays 902*a,b* on the PCB 900 in FIG. 9, may be used with an embedded horizontal antenna (such as the two-element arrays 604*a-c* in FIG. 6) to implement polarized diversity antenna structures for the 802.11a radios.

With reference to FIG. 10, the WLAN system 1000 includes a central PCB 1002 connected to four the RF sub-systems 1004*a-d*. The RF sub-systems 1004*a-d* may be connected to a substantially square central structure, which in FIG. 10 is the central PCB 1002. The four RF sub-systems 1004*a-d* may be connected to the four sides of the central PCB 1002 at four connectors 1010*a-d* to form the substantially circular wireless access point 1000 in FIG. 10.

The wireless access point 1000 in FIG. 10 includes multiple radios operating in a MIMO environment and providing 360° coverage as described with reference to FIGS. 1, 3, 4, and 8. The wireless access point 1000 in FIG. 10, however, includes implementation of radial sectors as shown in FIG. 3 as well as radial sectors as shown in FIG. 4. The main RF PCB 600 in FIG. 6 may also be configured to have a number of different radios, or ports, and by selecting the number of antenna PCBs 500 (in FIG. 5) or PCBs 900 (in FIG. 9) to add to the main RF PCB 600. For example, if the main RF PCB 600 includes one 802.11bg radio connected to three antennas as shown in FIG. 3, and three 802.11a radios connected to the three antennas structures on RF PCB 600, the wireless access point 1000 in FIG. 4 would include a total of 16 radios (or ports) arranged to provide 360° coverage. FIG. 11A to FIG. 12B show examples of configurations of main RF PCBs that may be used to provide a selected number of ports on a wireless access point with 360° coverage that uses MIMO. The examples in FIGS. 11A through 12B are described below in terms of IEEE 802.11a and IEEE 802.11bg radios, however, other examples may be implemented for other types of radios.

Figure 11A:
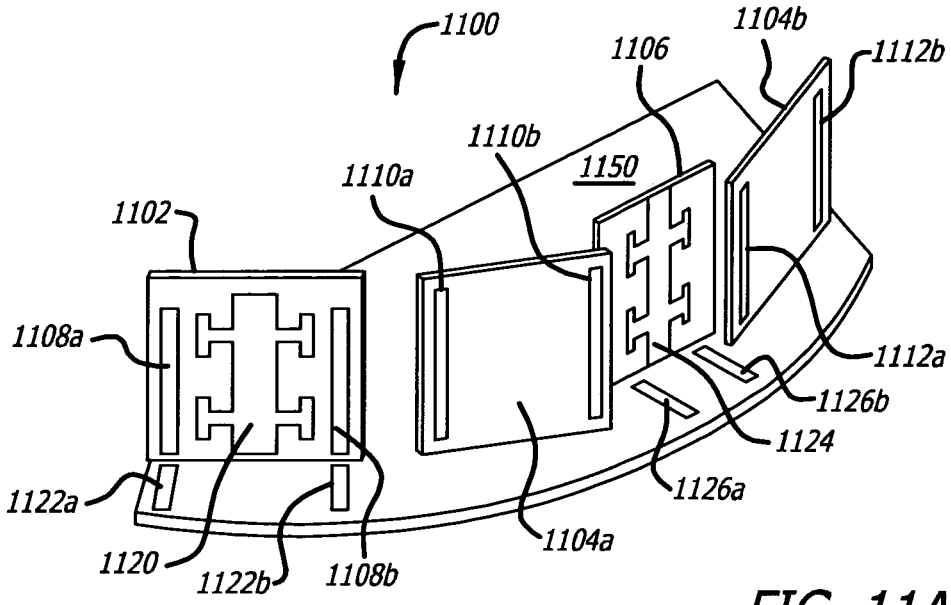
FIG. 11A is front view of an example main RF PCB that may be used to implement an 8-port WLANAA using MIMO with examples of antenna elements on an example of a PCB shown in FIG. 10.

FIG. 11A is front view of an example RF subsystem 1100 that may be used to implement an 8 port WLANAA using MIMO with a main RF PCB 1150 and a set of vertically mounted antenna PCBs that may include examples of antenna elements printed on the PCB 900 shown in FIG. 9. The main RF PCB 1150 may include one of the first types of radios, which for this example is the 802.11bg radio, and either one or two of the second type of radios, which for this example is the 802.11a radio.

The main RF PCB 1150 in FIG. 11A includes a dual-type antenna PCB 1102, two 'bg' antenna PCB 1104*a,b*, and one 'a' antenna PCB 1106. The dual-type antenna PCB 1102 may implement, at least partially, antennas for two MIMO radios of different types such as, the types of radios used in this example, which are the 802.11a and 802.11bg. The 'bg' antenna PCBs 1104*a,b* may implement two of the three antennas for the MIMO version of the 802.11bg radio. The 'a' antenna PCB 1106 may implement, at least partially, one of the types of antennas for one MIMO radio such as 802.11bg.

The main RF PCB 1150 in FIG. 11A may provide three dual-monopole antennas, one on the dual-type antenna PCB 1102, and two on the 'bg' antenna PCBs 1104*a,b*. The dual-type antenna PCB 1102 and the two 'bg' antenna PCBs 1104*a,b* may operate as the three-antenna MIMO interface for one 802.11bg radio to implement one of the four radial sectors 302*a-d* in FIG. 3.

The main RF PCB 1150 may also implement two of the three-antenna MIMO interfaces for each of two 802.11a radios using the dual-type antenna PCB 1102, and the second-type antenna PCB 1106 to implement three of the 12 radial sectors 402*a-l* in FIG. 4, or three of the 12 radial sectors 802*a-l* in FIG. 8. The dual-type antenna PCB 1102 includes a pair of dipole antennas with reflector in a structure 1108 similar to the antenna PCB 900 described above with reference to FIG. 9. The dipole antennas 1108 and a horizontal embedded antenna 1122*a,b* on the main RF PCB 1100 form the space diversity three-antenna MIMO interface for the sector defined for one of the two 802.11a radios on the main RF PCB 1100. The 'a' antenna PCB 1106 may be a second 'a' antenna structure, and may include a second pair of dipole antennas with reflector in a second structure 1124 similar to the structure 1120 on the dual-type antenna PCB 1102. The dipole antennas 1124 and a second horizontal embedded antenna 1126*a,b* on the main RF PCB 1150 may form a second space diversity three-antenna MIMO interface for a second 802.11a radio on the main RF PCB 1150. An 8-port MIMO wireless access point may be formed with four main RF PCBs 1150 where either one 'a' radio and the one 'bg' radio are configured to operate, or where the two 'a' radios are configured to operate.

Figure 11B:
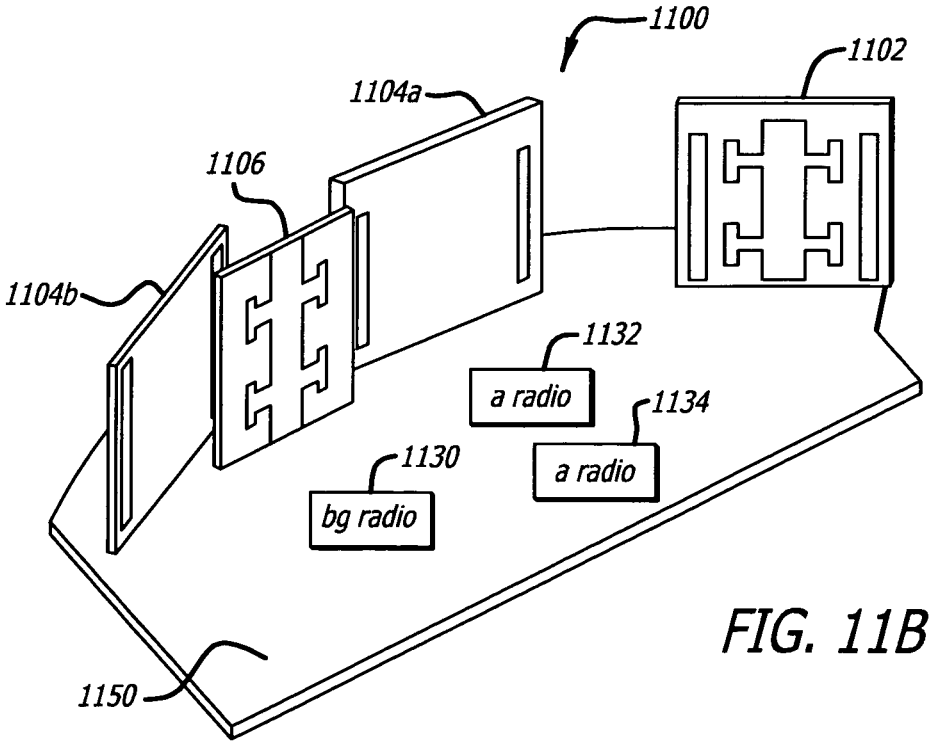
FIG. 11B is rear view of the main RF PCB shown in FIG. 11A.

FIG. 11B is rear view of the RF sub-system 1100 shown in FIG. 11A. The rear view shows a rear view of the main RF PCB 1150, the dual-type antenna PCB 1102, the two 'bg' antenna PCBs 1104*a,b*, and the 'a' antenna PCB 1106. The main RF PCB 1150 also includes one 'bg' radio 1130 and two 'a' radios 1132 and 1134.

The main RF sub-system 1100 in FIG. 11A may be connected to an edge of the central PCB 1002 in FIG. 10. The complete WLAN access point may therefore be configured to implement:

1. Four-port MIMO interface using: Four ports consisting of the 'bg' radios by using only the four 'bg' radios;
2. Four-port MIMO interface using: Four ports consisting of four 'a' radios by using only one of the two 'a' radios in each RF sub-system;
3. Eight-port MIMO interface using: the four ports consisting of the 'bg' radio in each RF sub-systems, and four of the eight ports available for the 'a' radios; or
4. Eight-port MIMO interface using: only the eight ports available using both 'a' radios in each RF sub-system.

Figure 12A:
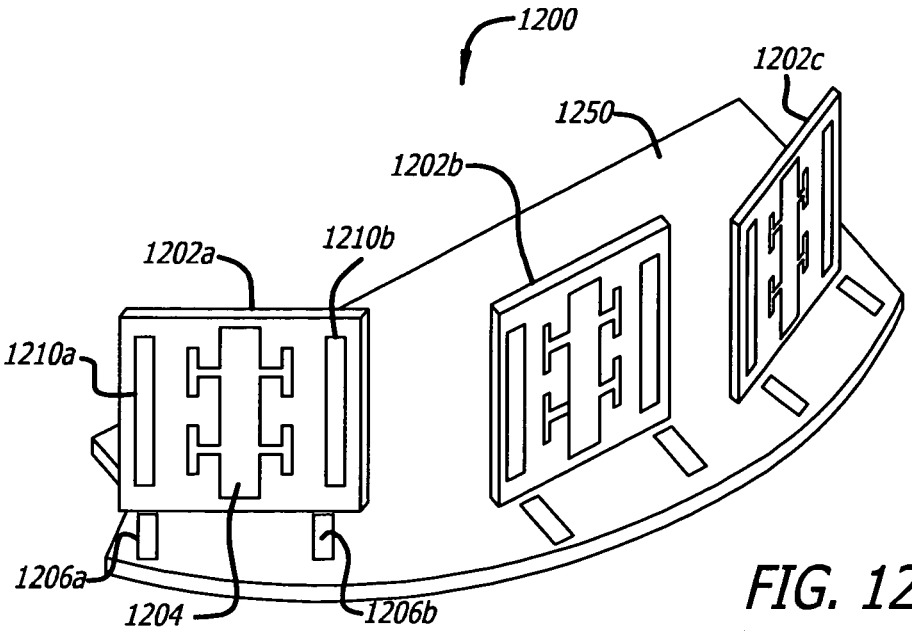
FIG. 12A is front view of an example main RF PCB that may be used to implement an 16-port WLANAA using MIMO with examples of antenna elements on all example of a PCB shown in FIG. 10.

FIG. 12A is front view of an example RF sub-system 1200 that may be used to implement a 16-port WLANAA using MIMO with examples of antennas on an example of the PCB 900 shown in FIG. 9. The RF sub-system 1200 may include one of the first type of radios, which for this example is the 802.11bg radio, and three of the second type of radios, which for this example is the 802.11a radio. The RF sub-system 1200 in FIG. 12A includes three dual-type antenna PCBs 1202*a-c*. The dual-type antenna PCBs 1202*a-c* may implement, at least partially, antennas for two MIMO radios of different types such as 802.11a and 802.11bg.

The dual-type antenna PCBs 1202*a-c* include dual-monopole antennas 1210*a-c*, one on each of the dual-type antenna PCBs 1202*a-c*. The dual-monopole antennas 1210*a-c* may operate as the three-antenna MIMO interface for one 802.11bg radio to implement one of the four radial sectors 302*a-d* in FIG. 3.

Each dual-type antenna PCB 1202*a-c* may also include two of the 'a' antennas at printed antenna locations 1204 to provide MIMO interfaces for three 802.11a radios, for example. The dual-type antenna PCBs 1202*a-c* may be mounted vertically on a main RF PCB 1250. The RF sub-system 1200 may use the dual-type antenna PCBs 1202*a-c* to implement three of the 12 radial sectors 402*a-l* in FIG. 4, or three of the 12 radial sectors 802*a-l* in FIG. 8. In one example, each of the dual-type antenna PCBs 1202*a-c* includes a pair of 1×2 dipole sub-arrays at printed antenna locations 1204*a-c*. The pair of 1×2 dipole subarrays 1204*a* on dual-type antenna PCB 1202*a* and a horizontal embedded antenna at horizontal location 1206*a* on the main RF PCB 1250 form the linear polarization diversity three-antenna MIMO interface for the sector defined for one of the three 802.11a radios on the main RF PCB 1250.

Figure 12B:
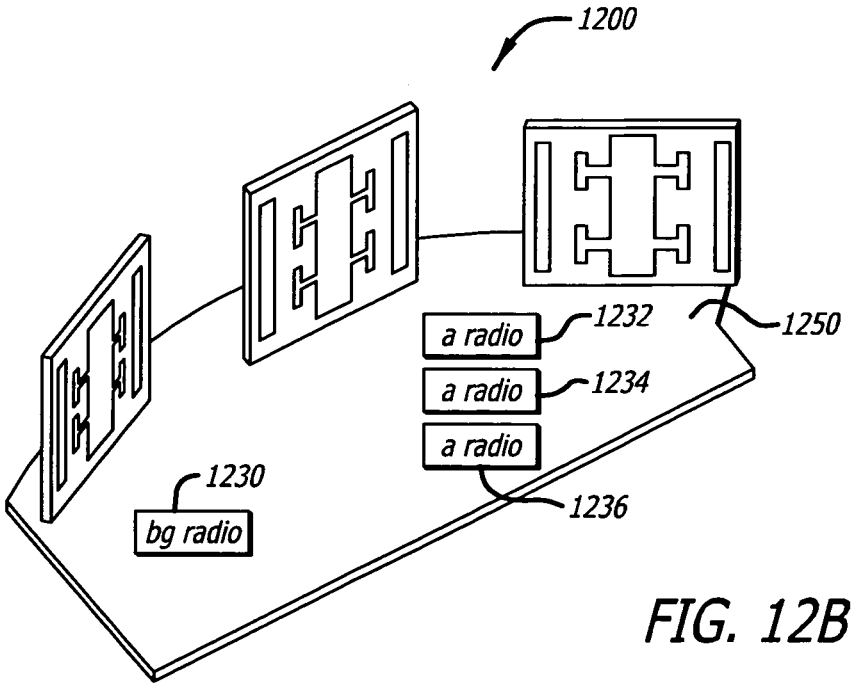
FIG. 12B is rear view of the main RF PCB shown in FIG. 12A.

FIG. 12B is a rear view of the RF subsystem 1200 shown in FIG. 12A. The rear view shows a rear view of the main RF PCB 1250, and the dual-type antenna PCBs 1202 The main RF PCB 1250 also includes one 'bg' radio 1230 and three 'a' radios 1132, 1134 and 1136.

The main RF PCB 1200 in FIG. 12A may be connected to an edge of the central PCB 1002 in FIG. 10. The complete WLAN access point may therefore be configured to implement:

1. Four Port MIMO interface: using only the four 'bg' radios on the four main RF PCBs;
2. Eight Port MIMO interface: using the 'bg' radio, and one of the eight ports available for the 'a' radio (for example, four 802.11a radios); and
3. Sixteen Port MIMO interface: using the four 'bg' radios, and the twelve 'a' radios.

It will be understood that the foregoing description of numerous implementations has been presented for purposes of illustration and description. It is not exhaustive and does not limit the claimed inventions to the precise forms disclosed. For example, the above examples have been described as implemented according to IEEE 802.11a and 802.11bg. Other implementations may use other standards. In addition, examples of the wireless access points described above may use housings of different shapes, not just round housing. The number of radios in the sectors and the number of sectors defined for any given implementation may also be different. Modifications and variations are possible in light of the above description or may be acquired from practicing the invention. The claims and their equivalents define the scope of the invention.

What is claimed is:

1. A wireless local area network ("WLAN") antenna array ("WLANAA") comprising:

a circular housing having a plurality of radial sectors; and at least one radio in each radial sector, each of the at least one radio having:

a plurality of transceivers configured to send and receive wireless communications via a plurality of antenna elements configured as Mulitple-Input, Multiple-Output ("MIMO") antennas wherein each of the plurality of antenna elements are positioned within an individual radial sector of the plurality of radial sectors; and a baseband processor configured to process baseband signals to be sent or received by the plurality of transceivers.

2. The WLANAA of claim 1 further including at least one absorber element between each radial sector.

3. The WLANAA of claim 2 further including a plurality of absorber elements where each absorber element of the plurality of the absorber elements is located between an adjacent pair of primary antenna elements.

4. The WLANN of claim 1 where the plurality of radios are coupled to MIMO antennas that are of:

a first type of MIMO antennas for communicating signals that conform to the IEEE 802.11bg standard; or a second type of MIMO antennas for communicating signals that conform to the IEEE 802.11a standard.

5. The WLANAA of claim 4 where the first type of MIMO antennas include three dual-monopole antennas substantially evenly spaced along a perimeter of the radial sector of the radio connected to the first type of MIMO antennas.

6. The WLANAA of claim 4 where the second type of MIMO antennas include two dual-polarized antennas configured at the +45° and −45° polarizations and one two-element dipole antenna orthogonal to the dual-polarized antennas.

7. The WLANAA of claim 6 where the two-element dipole antenna is embedded on a main RF printed circuit board ("PCB") and the two dual-polarized antennas are printed on an antenna printed circuit board ("antenna PCB") mounted substantially vertical relative to the main RF PCB.

8. The WLANAA of claim 7 where the two dual-polarized antennas are two element patch antenna sub-arrays configured at the +45° and −45° polarizations.

9. The WLANAA of claim 4 where the second type of MIMO antennas include two linearly polarized antennas and one two-element dipole antenna orthogonal to the two linearly polarized antennas.

10. The WLANAA of claim 9 where the two-element dipole antenna is embedded on a main RF printed circuit board ("PCB") and the two dual-polarized antennas are printed on an antenna printed circuit board ("antenna PCB") mounted substantially vertical relative to the main RF PCB.

11. The WLANAA of claim 9 where the two linearly polarized antennas are two 1×2 dipole element sub-arrays.

12. The WLANAA of claim 9 further comprising a reflector between the two 1×2 dipole element sub-arrays.

13. The WLANAA of claim 1 where the at least one radio in each radial sector communicates over a first type of MIMO antennas for communicating signals that conform to the IEEE 802.11bg standard, the WLANAA further including:

a second plurality of radial sectors within the same circular housing, each of the second plurality of radial sectors including a second type of radio for communicating via a second plurality of antenna elements configured as second-type MIMO antennas for communicating signals that conform to the IEEE 802.11a standard.

* * * * *